United States Patent [19]

Namiki et al.

[11] Patent Number: 4,992,636

[45] Date of Patent: Feb. 12, 1991

[54] SEALED CONTAINER FOR MICROWAVE OVEN COOKING

[75] Inventors: Tsunehisa Namiki; Ikuo Sugiyama, both of Kanagawa; Tamio Fujiwara, Osaka; Kazuhisa Ishibashi, Tokyo; Isao Tanikawa, Kanagawa; Muneki Yamada, Kanagawa; Kyuichi Shibasaki, Kanagawa, all of Japan

[73] Assignee: Toyo Seikan Kaisha Ltd., Tokyo, Japan

[21] Appl. No.: 368,383

[22] PCT Filed: Sep. 30, 1988

[86] PCT No.: PCT/JP88/00996

§ 371 Date: Jun. 5, 1989

§ 102(e) Date: Jun. 5, 1989

[87] PCT Pub. No.: WO89/02715

PCT Pub. Date: Apr. 6, 1989

[30] Foreign Application Priority Data

| | | | |
|---|---|---|---|
| Oct. 5, 1987 | [JP] | Japan | 62-250026 |
| Feb. 6, 1988 | [JP] | Japan | 63-24941 |
| Apr. 25, 1988 | [JP] | Japan | 63-100237 |

[51] Int. Cl.[5] ..... H05B 6/80

[52] U.S. Cl. ..... 219/10.55 E; 219/10.55 F; 426/107; 426/118; 426/234; 426/243; 99/451; 99/DIG. 14; 220/367

[58] Field of Search ..... 219/10.55 E, 10.55 F, 219/10.55 R; 426/107, 111, 113, 118, 241, 234, 243; 229/DIG. 14, 35 MF; 220/363, 367; 99/451, DIG. 14

[56] References Cited

U.S. PATENT DOCUMENTS

| | | | |
|---|---|---|---|
| 4,141,487 | 2/1979 | Faust et al. | 426/113 |
| 4,210,674 | 7/1980 | Mitchell | 426/107 |
| 4,320,274 | 3/1982 | Dehn | 219/10.55 E |
| 4,640,838 | 3/1987 | Isakson | 426/107 |

FOREIGN PATENT DOCUMENTS 218419 4/1987 European Pat. Off. .

*Primary Examiner*—Philip H. Leung
*Attorney, Agent, or Firm*—Schwartz & Weinrieb

[57] ABSTRACT

A container body is sealed by means of a lid made of a flexible sheet having an insulative property and an antenna made of an electrically conductive material which is laminated upon the lid. According to this construction, when the container body is exposed to microwaves within a microwave oven, microwave energy is concentrated at a position near the front end of the antenna and the microwave energy is converted into heat energy, whereby the lid is opened by means of the thus converted heat. The lid can thus be precisely partially melted so as to form an opening of a predeterminedly suitable size.

27 Claims, 10 Drawing Sheets

SEALED CONTAINER FOR MICROWAVE OVEN COOKING

FIELD OF THE INVENTION

This invention relates to a sealed container for accommodating food therein and, more particularly, to a sealed container containing food to be cooked within a microwave oven, within which an opening is automatically opened within the lid of the sealed container for discharging vapor generated during the time when the container filled with the food is heated so as to cook the food within the microwave oven.

BACKGROUND OF THE INVENTION

In the case where it is required to heat and cook food contained within a sealed container made of a plastic or paper material, it is convenient to heat the container with the food contained therein in a wrapped condition. Namely, in general, when the food is heated by means of an electronic oven, particularly a microwave oven, in a wrapped condition, the container is liable to be ruptured by means of the inner pressure which is increased by means of vapor generated during the heating process. In such a case, the food contained within the container is often scattered upon and throughout the interior surfaces of the oven. On the other hand, when the food within the container is heated with the lid of the container removed, the food may be denatured due to the diffusion of the vapors generated during the heating process In order to eliminate this problem, there has previously been provided means for automatically opening the lid of the container when the food sealed within the container is heated by means of the microwave oven. According to the technique disclosed within Japanese Patent Laid-open Publication No. 61-69576, an adhesive layer comprising non-metallic type microwave absorbing particles is applied to the lid of the container. In addition, according to the technique disclosed within U.S. Pat. No. 4,210,674, an electrically conductive material is applied to the lid of the container and the composition of the conductive material is designed so as to absorb the energy. According to these methods, the lid is heated and partially melted so as to be opened as a result of the provision of the microwave absorbing material.

In connection with the use of electronic or microwave ovens, a standing wave is generated within the oven casing and, hence, the strength of the microwaves is not uniformly distributed. With the methods of the conventional techniques described above in which the microwaves are absorbed and the lid is opened as a result of the heat generated by means of the heat generating material or element, in a case where the heat generating material is applied upon a portion of the bid at which the strength of the microwave is weak, there may result a case wherein the lid is not opened due to inadequate heating thereof. In the case where the heat generating material having a large size is utilized so as to open the container lid within the low strength region of the microwave, and if the heat generating material is positioned within the high strength region of the microwave, a widened opening may be formed within the lid of the container, through which a large amount of the vapor will be dispersed whereby the food will be denatured.

OBJECTS OF THE INVENTION

Accordingly, this invention was conceived in order to solve the problems of the prior art described above, and an object of this invention is to provide a sealed container, containing food to be cooked within a microwave oven, upon which a lid made of an insulative flexible sheet material is exposed to the microwaves within the electronic oven, whereby the lid is rapidly heated within a short period of time so as to provide a melted opening having a precisely controlled size.

Another object of this invention is to provide a sealed container, containing food to be cooked within a microwave oven, upon which a lid of the container is rapidly heated in a short period of time so as to provide a melted opening having a precisely controlled size even in the case where there exists regions within the interior of the oven at which the oscillation directions of the microwaves are different from each other.

A further object of this invention is to provide a sealed container, container food to be cooked within a microwave oven, upon in which a lid made of an insulative flexible sheet material or wherein a container in the form of a bag made of an insulative flexible material is exposed to the microwaves within the microwave oven, the lid of the container or the container bag or pouch can be reliably opened after a predetermined period of time has elapsed, and to also provide the same with reduced cost.

DISCLOSURE OF THE INVENTION

In order to achieve the objects described above, according to this invention, there is provided a sealed container containing food to be cooked within a microwave oven, characterized in that an antenna made of an electrically conductive material is laminated upon the lid of the container body to be sealed by means of the lid which is made a flexible insulative material, energy caused by means of microwaves is concentrated near the opposing front portions of the antenna when the container body is exposed to the microwaves within the microwave oven, and the energy is converted into heat energy by means of which the lid is opened.

The heat generating operation is further increased by arranging the heat generating material within a region at which the microwave energy is concentrated. In the case where the heat generating material is so arranged, the microwave energy is converted into heat energy by arranging the heat generating material at the corner portion of the antenna instead of arranging the same at the opposing front portions thereof, whereby the lid is opened by means of the heat energy.

According to the structure described above, an alternating current passes through the antenna which is made from a good electrically conductive material when the microwaves are generated, and a high density electrical field and high magnetic field of high frequency are generated at a position at which ends of the antenna are opposed with respect to each other or at a corner portion of the antenna. In the case where a resistance, such as, for example, a heat generating element is arranged at the position where the high density electrical field and high density magnetic field are created, heat is generated due to the Joule heat caused by means of the current passing through the heat generating element, and where a dielectric element is used as the heat generating element and is arranged at a position within the high density electrical field region, heat is generated by means of the dielectric heating of the dielectric element. Furthermore, in the case where a magnetic material used as a heat generating element is disposed at a position where the high density magnetic field is created, heat is generated by means of the hysteresis phenomenon of the magnetism. The antenna does not generate any significant amount of heat, so that heat diffusion from the antenna is reduced even if a large-sized antenna is utilized, and since a large amount of the energy concentrated by means the antenna having a large size is converted into heat energy by means of the heat generating element having a small size, the lid of the container can be rapidly heated to a high temperature, whereby the lid of the sealed container can be reliably opened when the container is heated while the food is being cooked within the microwave oven.

Furthermore, in order to achieve the objects of this invention, according to this invention, there is provided a sealed container containing food to be cooked within a microwave oven, characterized in that an antenna made of an electrically conductive material is disposed upon the lid of the container body sealed by means of the lid which is made from an flexible insulative sheet material, the antenna being provided with a portion which is inclined by means of an angle having an inclination which is greater than approximately about 3° with respect to the horizontal plane so as to concentrate microwaves upon a specified portion of the antenna and when the container is exposed to the microwaves within the electronic oven, energy concentrated by means of the antenna is converted into heat energy, and the lid is opened by means of the converted heat. Various kinds of antennas can be utilized. When a belt shaped antenna is utilized, the microwave energy is concentrated toward the front portion thereof, which when a C-shaped antenna is utilized, the energy is concentrated toward the opposing ends thereof, and when a plurality of antennas are utilized in combination, the energy is concentrated at positions at which end portions of the antennas are arranged close to each other. The concentrated energy derived from the microwaves is converted into heat energy by means of the heat generating element laminated upon the lid, and the microwave energy may also be converted into heat energy means of the dielectric loss of the lid.

According to the structure described above, standing waves are caused within the interior of the microwave oven and the microwaves within the microwave oven have their vertical and horizontal oscillation components on reflected upon the vertical and horizontal walls thereof because of the rectangular configuration of the microwave oven. The vertical and horizontal oscillation components are sometimes different from each other with respect to their relative strengths. According to the antenna of this invention for receiving the microwaves, since the antenna is provided with vertically and horizontally directed portions, the microwave energy can be effectively concentrated even if the vertical and horizontal oscillation components of the microwaves are different in their relative strengths. The concentrated microwave energy is thus converted into heat energy by means of the heat generating element or the lid of the container so as to thereby partially melt or open the opening of the lid.

Accordingly, even in the case wherein the microwave oven includes inner regions upon which the oscillation directions of the microwaves are different, the lid of the sealed container can nevertheless be rapidly heated and partially melted in a relatively short period of time, thus reliably forming an opening having a proper size.

Furthermore, in order to achieve the objects, according to this invention, there is provided a sealed container containing food to be cooked within a microwave oven, characterized in that an electrically conductive layer having the configuration of a linear belt for concentrating microwaves and a heat generating layer for converting the microwave energy into heat energy are arranged at a distance within the range of 0 to 3.5 mm, these layers being contained within a label and the label is stuck upon the lid, which is made of a flexible insulative material, of the sealed container or upon a bag or pouch made of a flexible material having an insulative property.

On the label are laminated a base layer, an adhesive layer, a conductive liner layer and a heat generating layer, the conductive liner layer having a length greater than 20 mm and a surface resistivity less than 1Ω per square.

According to the structure described above, since the conductive layer has an adequate length, the conductive layer can stably concentrate the microwave energy toward the heat generating layer even at a location within the standing wave region of the microwaves. The heat generating element is preferably made of a material suitable for converting the microwave energy into heat energy such as, for example a conductive material, having a high resistivity, a dielectric material or a magnetic material, or a combination of these materials. The microwave energy is converted into heat energy by means of the resistance losses, dielectric losses, or magnetism losses and the lid of the container body or the label of the bag is partially melted by means of the converted heat so as to thereby form an opening therein. The base layer is arranged so as to provide the label with a proper rigidity so as to easily release the label from a releasing layer or to adhere the label to the lid, thus improving the manufacturing cost. The adhesive layer serves to adhere the label to the lid or pouch. The conductive layer serving as an antenna has a long length of approximately 20 mm, so that the microwave energy is effectively concentrated and the lid or bag can be reliably opened regardless of the location of the container or bag within the microwave oven.

BRIEF DESCRIPTION OF THE DRAWINGS

Various other objects, features, and attendant advantages of the present invention will become more apparent from the following detailed description, when considered in connection with the accompanying drawings in which like reference characters designate like or corresponding parts throughout the several views, and wherein:

FIG. 23 is a perspective view of a sealed container constructed in accordance with the eighteenth embodiment of this invention;

BEST MODES FOR CARRYING OUT INVENTION

Figure 1:
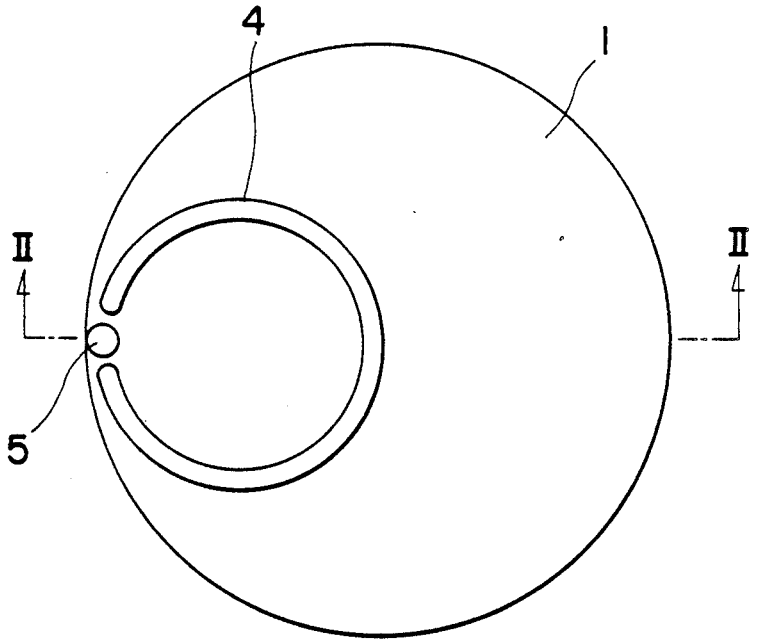
FIG. 1 is a plan view of a sealed container constructed in accordance with the first embodiment of this invention.
Figure 2:
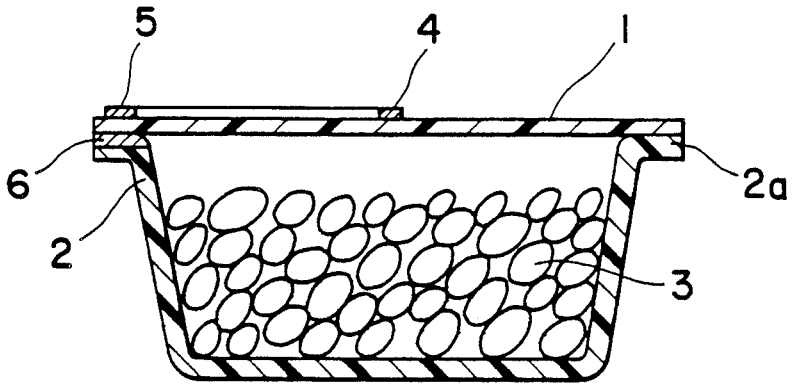
FIG. 2 is a sectional view taken along the line 2—2 in FIG. 1.

The embodiments developed according to this invention will now be described hereunder with reference to the drawings. FIGS. 1 and 2 represent the first embodiment developed according to this invention. Referring to the figures, reference numeral 1 designates a lid made of a plastic sheet having thermoplasticity characteristics and adapted to heat seal a flanged portion 2*a* of a container body 2 which is made of a material having plasticity and into which a preserved food 3 is disposed. A C-shaped antenna 4 made of an electrically conductive material and a heat generating element 5 made of a high resistance material are laminated upon the surface of the lid 1. The heat generating element 5 is disposed upon an upper surface portion of the heat seal portion of the lid 1 and the antenna 4 is positioned so that the heat generating element 5 is interposed between both ends of the C-shaped antenna 4. The antenna 4 is prepared by coating the same with a conductive coating agent containing conductive powders, by means of either vacuum evaporation, a spattering method, flame coating of a conductive material, a chemical plating method, or a bonding of a metallic foil, and the heat generating element 5 is formed by coating the same with a binder including high resistance powders or the bonding of a conductive plastic sheet. The antenna 4 and the heat generating element 5 may be directly laminated upon the lid 1 or may be laminated upon a plastic sheet so as to form a label, which is then bonded on upon the lid 1. In the case where the heat generating element 5 is formed by coating the same with a binder including high resistance powders, the binder is partially melted when the heat generating element 5 is heated to a temperature greater than a predetermined value, and when the binder is partially melted, the heat generation of the heat generating element creases, so that the lid 1 cannot be abnormally heated whereby the lid is prevented from being subjected to heat decomposition. A foamable material 6 is disposed upon the flange 2*a* of the container body 2 at a position corresponding to the location of the heat generating element 5 arranged upon the lid 1. When the enclosure thus constructed is exposed to the microwaves within the interior of the microwave oven, the current passing through the antenna 4 creates a high density electric field for the heat generating element 5 so as to pass the current through the heat generating element 5, whereby the heat generating element 5 generates heat and the sealed portion heated by means of the heat generating element 5 is partially melted and opened. After cooking within the microwave oven, the lid 1 can be easily separated from the container body 2 by pulling the lid within the vicinity of the opened seal portion. The location of the foamable material at the seal portion can further facilitate the easy separation of the lid 1 from the container body 2.

Figure 3:
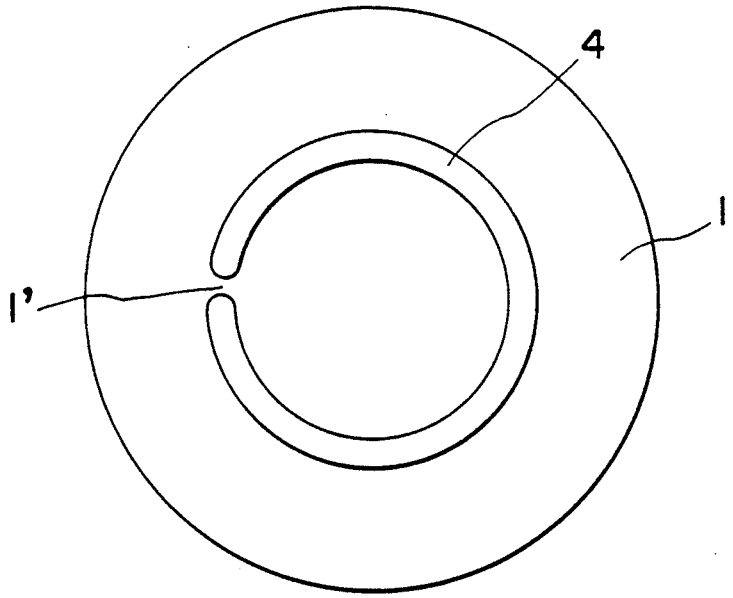
FIG. 3 is a plan view of a lid of a sealed container constructed in accordance with the second embodiment of this invention.

FIG. 3 is a plan view of a lid of a sealed container developed according to the second embodiment of this invention. Referring to the figure, reference numeral 4 designates a C-shaped antenna 4 made of an electrically conductive material and the antenna 4 is laminated upon the lid 1 in a manner similar to that described with reference to the first embodiment. The lid 1 is heat sealed in a manner substantially the same as that described in connection with the first embodiment. According to this embodiment, a high density electric field is created between the opposed ends of the C-shaped antenna 4 through which a current passes at caused by means of the microwaves, whereby a portion 1' near the opposed ends of the antenna 4 is partially melted and opened means of the dielectric heating.

Figure 4:
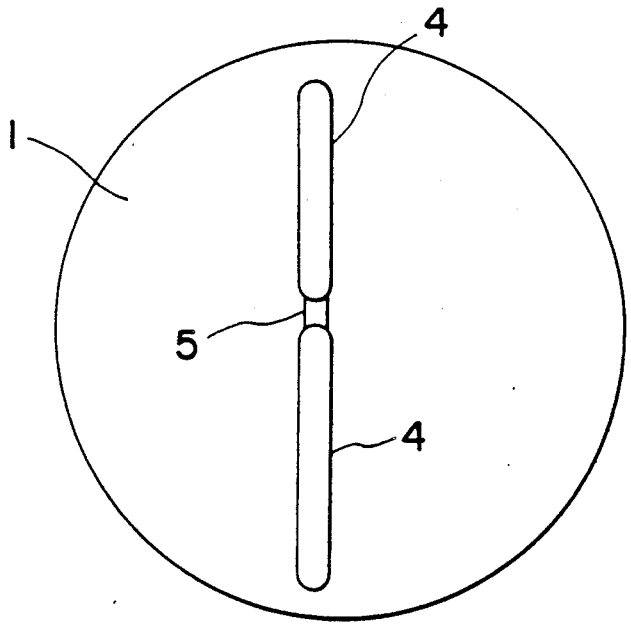
FIG. 4 is a plan view of a lid of a sealed container constructed in accordance with the third embodiment of this invention.

FIG. 4 is a plan view of the lid used for the sealed container of the third embodiment of this invention. Referring to the figure, reference number 4 and 4 designates antennas in the form of linear belts made of an electrically conductive material, which are to be laminated upon the lid 1 by substantially the same process as that described with reference to the first embodiment. A heat generating element 5 is also laminated upon the lid 1 so as to connect the opposed ends of the antennas 4 and 4. The heat generating element 5 may be formed of the same material as that of the antenna 4 or of a material different from that of the antenna, but it is necessary for the heat generating element 5 to have a resistance greater than that of the antenna 4 with respect to the unit lengths thereof. In the case where the heat generating element 5 is made of the same material as that of the antenna 4, the heat generating element 5 should be designed so as to have a width or thickness smaller than that of the antenna 4. In the illustrated embodiment, the heat generating element 5 is connected to the antennas 4 and 4, but the heat generating element 5 may simply be disposed close to the end portions of the antennas 4 and 4. When the lid 1 of the construction described above is utilized in the manner described with reference to the first embodiment, the high density electric field is created between the antennas 4 and 4 so as to thereby pass the current through the heat generating element 5, whereby the heat generating element 5 generates heat.

Figure 5:
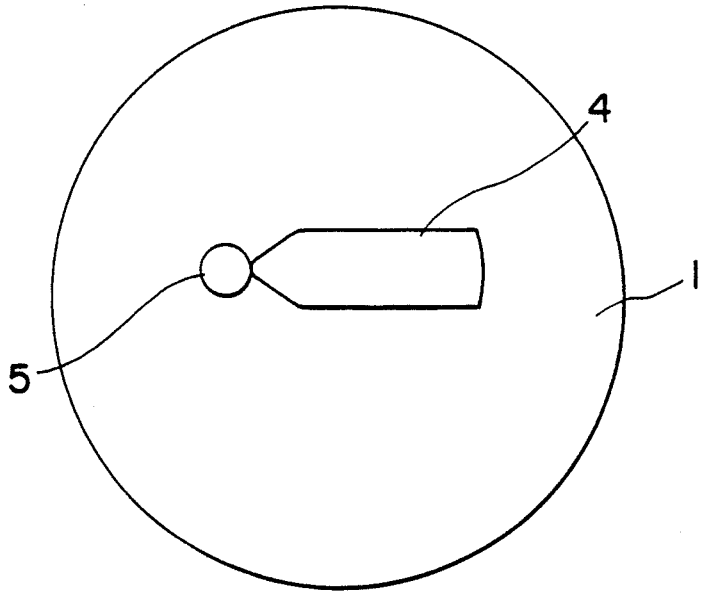
FIG. 5 is a plan view of a lid of a sealed container constructed in accordance with the fourth embodiment of this invention.

FIG. 5 is a plan view of the lid used for a sealed container according to the fourth embodiment of this invention. Referring to the figure, reference numeral 4 designates an antenna made of an electrically conductive material and formed substantially in the shape of a belt, which is to be laminated upon the lid 1 in a manner similar to that previously described with reference to the first embodiment. A heat generating element 5 made of a high resistance material is laminated upon the lid 1 in such a manner that the heat generating element 5 contacts the front end of the antenna 4. In the illustrated embodiment, the heat generating element 5 contacts the front end of the antenna 4, but the heat generating element 5 may simply be disposed in close to the antenna 4. When the lid 1 having the construction described above is utilized in the manner described with reference to the first embodiment, the high density electric field created by means of the antenna 4 is applied to the heat generating element 5 so as to heat the heat generating element 5, whereby the lid 1 is partially melted and opened.

Figure 6:
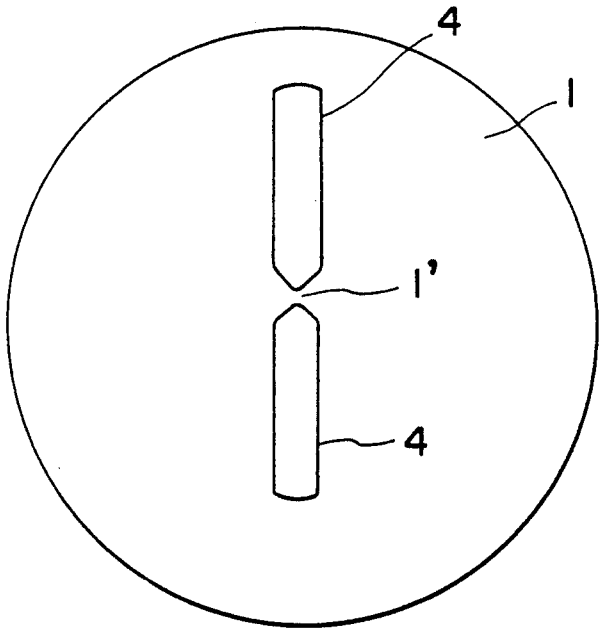
FIG. 6 is a plan view of a lid of a sealed container constructed in accordance with the fifth embodiment of this invention.

FIG. 6 is a plan view of a lid used for a sealed container constructed in accordance with the fifth embodiment of this invention. Referring to the figure, reference numerals 4 and 4 designate antennas made of an electrically conductive material and laminated upon the lid 1 in a manner similar to that described with respect to the first embodiment such that the front end portions of the antennas 4 and 4 are oppositely disposed adjacent to each other. When the lid 1 having the construction described above is utilized in the manner described with reference to the first embodiment, the high density electric field is created between the antennas 4 and 4, whereby the portion 1' of the lid 1 defined between the antennas 4 and 4 is partially melted and opened by means of the dielectric heating.

Figure 7:
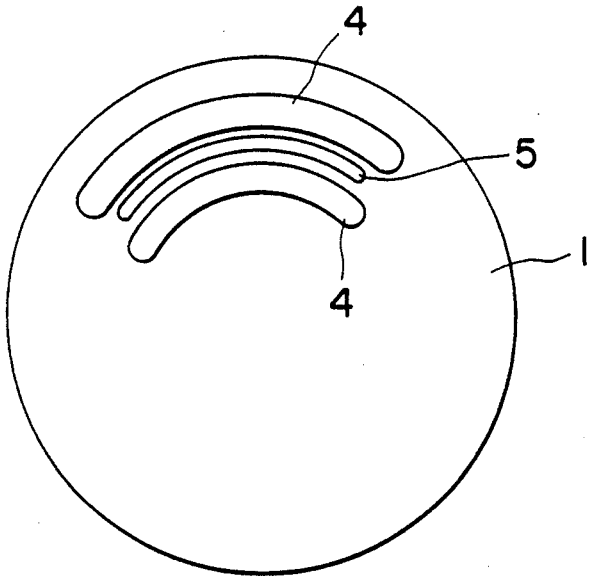
FIG. 7 is a plan view of a lid of a sealed container constructed in accordance with the sixth embodiment of this invention.

FIG. 7 is a plan view of a lid used for a sealed container and constructed according to the sixth embodiment of this invention. Referring to the figure, reference numerals 4 and 4 designate antennas made of an electrically conductive material and formed so as to have arcuate shapes, and an arcuate heat generating element 5 made of ferrite SF-547 manufactured by TODA KOGYO and an epoxy resin is laminated upon the lid 1 so as to be interposed between and, extend along the arcuate longitudinal sides of the antennas 4 and 4 in a manner similar to that described with reference to the first embodiment. When the lid 1 having the construction described above is utilized as in the first embodiment, the heat generating element made of the ferrite and epoxy resin materials generates the heat, whereby the lid 1 is opened along a substantially linear extent.

Figure 8:
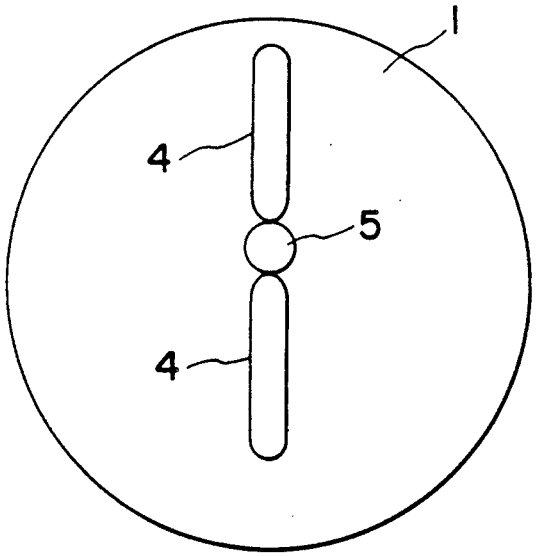
FIG. 8 is a plan view of a lid of a sealed container constructed in accordance with the seventh embodiment of this invention.

FIG. 8 is a plan view of a lid used for a sealed container constructed according to the seventh embodiment of this invention. Referring to the figure, reference numerals 4 and 4 designate antennas made of an electrically conductive material and the antennas 4 and 4 are laminated upon the lid 1 in such a state that a heat generating element 5 comprising a metallic aluminum evaporation film is laminated upon the lid 1 as described with reference to the first embodiment so as to be interposed between the opposing ends of the antennas 4 and 4. When the lid 1 having the construction described above is utilized as in the first embodiment, the heat generating element made from the evaporation film is heated by means of the electric field developed between the antennas 4 and 4 and the lid 1 is thereby opened.

Figure 9:
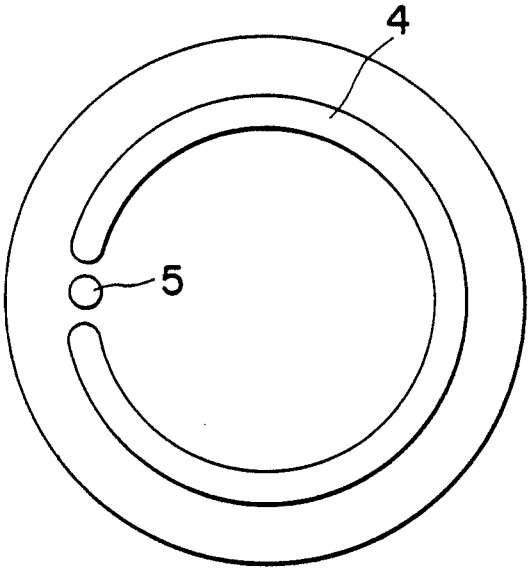
FIG. 9 is a plan view of a lid of a sealed container constructed in accordance with the eighth embodiment of this invention.

FIG. 9 is a plan view of a lid of a sealed container constructed according to the eighth embodiment of this invention. Referring to the figure, reference numeral 4 designates a C-shaped antenna made of an electrically conductive material, and reference numeral 5 designates a heat generating element made of barium titanate and an epoxy resin and laminated upon the lid 1 in a manner similar to that described with reference to the first embodiment so as to be interposed between the opposed ends of the antenna 4. When the lid 1 is utilized as described in connection with the first embodiment, the heat generating element 5 made from the barium titanate-epoxy resin is dielectrically heated by means of the high density electric field developed between the end portions of the antenna 4, whereby the lid 1 is opened.

Figure 10:
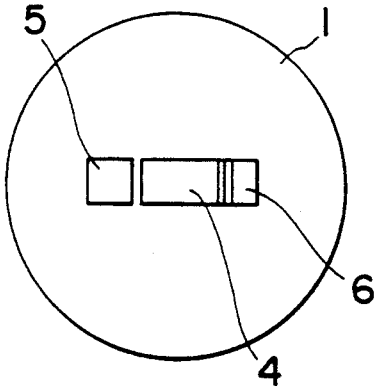
FIG. 10 is a plan view of a lid of a sealed container constructed in accordance with the ninth embodiment of this invention.
Figure 11:
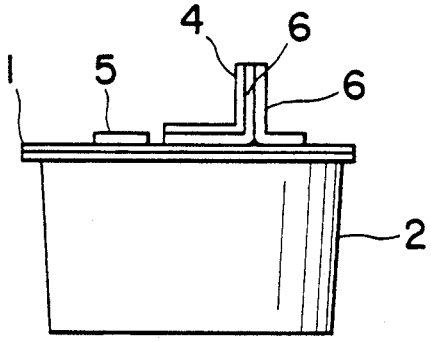
FIG. 11 is a side view of the sealed container shown in FIG. 10.
Figure 12:
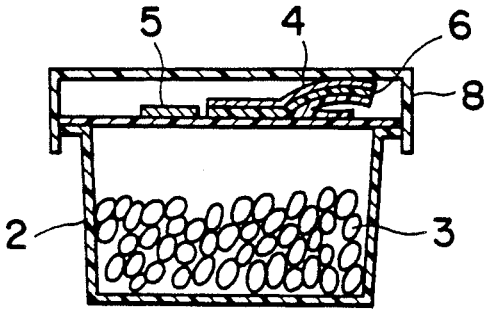
FIG. 12 is a cross sectional view of the sealed container shown in FIG. 10.

FIGS. 10 to 12 represent the ninth developed according to this invention. Referring to the figures, reference numeral 1 designates a lid made from a flexible sheet having an insulative property, and the lid 1 is heat sealed to a flanged portion of a container body 2 which is made from a plastic material and into which a preserved food 3 is deposited. A laminate composed of an antenna 4 made from an electrically conductive material and formed in the shape of a linear belt and a flexible sheet 6 having an insulative property is bonded to the lid 1. A heat generating element 5 is bonded to the lid 1 at a position close to the antenna 4. The flexible sheet 6 is composed of two sheet elements which have portions bonded to each other and the remaining portions, not bonded to each other, are bonded to the lid 1 so as to extend in directions opposite to each other. The bonded portions extend vertically upwardly as best seen in FIG. 11 and exhibit a predetermined amount of rigidity, elasticity, and flexibility. The flexible sheet 6 are bent substantially horizontally by as a result of temporarily applying a lid 8 to the container as shown in FIG. 12 when the sealed container is prepared, but when the sealed container is inserted into the electronic oven, the lid 8 is removed and the bonded portions of the flexible sheet 6 then return to the standing position as shown in FIG. 11. In the state shown in FIG. 11, the antenna 4 extends in the vertical and horizontal directions substantially in an L shape, so that the antenna 4 can effectively concentrate the microwave energy toward the heat generating element 5 even in the case where only one of the vertical or horizontal components of the microwaves is strong, whereby the heat generating element 5 generates the heat adequate to partially melt and open the lid 1.

Figure 13:
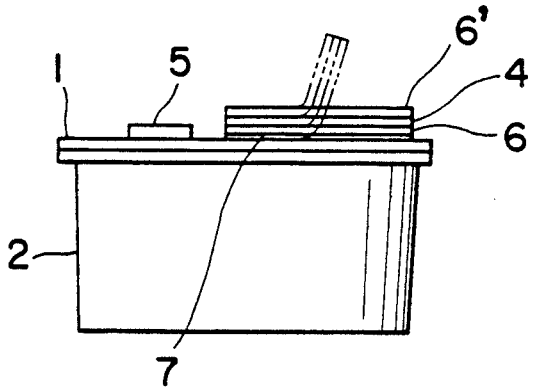
FIG. 13 is a side view of a sealed container constructed in accordance with the tenth embodiment of this invention.

FIG. 13 is a side view of a sealed container constructed according to the tenth embodiment of this invention. Referring to the figure, reference numeral 4 designates an antenna made of an electrically conductive material which is laminated between flexible sheets 6 and 6' having an insulative property in a sandwiched manner. The coefficient of thermal contraction of the flexible sheet 6' in the longitudinal direction thereof is greater than that of the flexible sheet 6. A part of the thus formed laminate is bonded to the lid 1 made from a flexible insulative sheet through means of a layer 7 of a bonding agent. A heat generating element 5 is bonded to the lid 1 at a position close to one end of the antenna 4. When the sealed container thus formed is heated within the electronic oven, the antenna 4 is bent so as to have a vertical component as shown means of the dot and dash lines in FIG. 13 as a result of the thermal contraction of the flexible sheets 6 and 6'.

Figure 14:
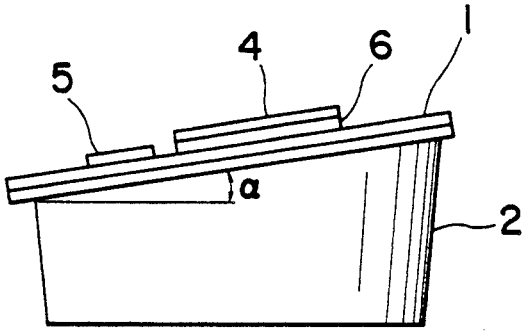
FIG. 14 is a side view of a sealed container constructed in accordance with the eleventh embodiment of this invention.

FIG. 14 is a side view of a sealed container constructed according to the eleventh embodiment of this invention. A lid 1 made from a flexible sheet having an insulative property is heat sealed to a flanged portion of a container body 2 which has an inclination $\alpha$ with respect to the bottom surface of the container body 2. It is desired that the inclination $\alpha$ is greater than approximately 3°. A laminate composed of the antenna 4 and the flexible sheet 6 is bonded to the lid 1 so that the laminate has its entire length disposed at an incline such that one end thereof is disposed at a higher level than the opposite end thereof. The heat generating element 5 is bonded to the lid 1 at a position in close to the lower end of the antenna 4. Accordingly, in this embodiment, the antenna 4 has the vertical and horizontal components inherently defined along the longitudinal direction thereof.

Figure 15:
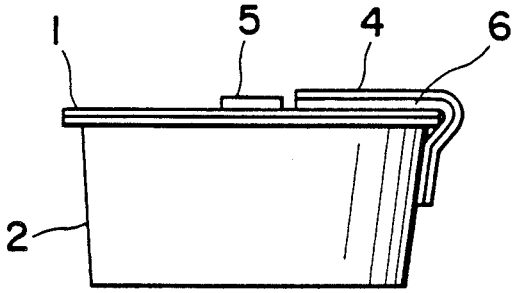
FIG. 15 is a side view of a sealed container constructed in accordance with the twelfth embodiment of this invention.

FIG. 15 is a side view of a sealed container constructed according to the twelfth embodiment of this invention. A lid 1 made from a flexible sheet having an insulative property is heat sealed to a flanged portion of a container body 2. A laminate flexible insulative composed of the conductive antenna 4 and the insulative flexible sheet 6 is bonded to the lid 1 and a side portion of the container body 2. A heat generating element 5 is bonded to the lid 1 at a position close to the end of the antenna 4. In this embodiment, the antenna 4 also has the vertical and horizontal components inherently defined along the longitudinal direction thereof.

Figure 16:
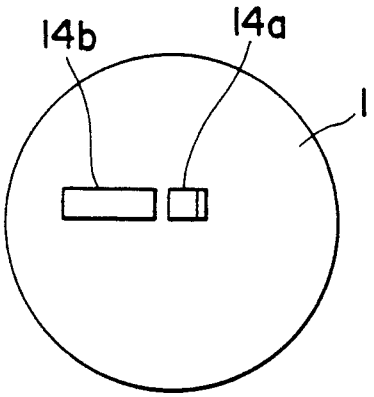
FIG. 16 is a plan view of a sealed container constructed in accordance with the thirteenth embodiment of this invention.
Figure 17:
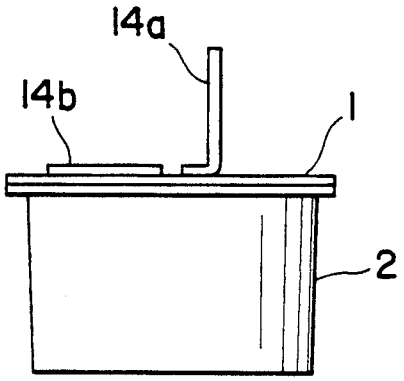
FIG. 17 is a side view of the sealed container shown in FIG. 16.

FIGS. 16 and 17 represent the thirteenth embodiment developed according to this invention, in which a pair of lamination **14*a* and 14*b* each composed of a belt-shape antenna and an flexible insulative sheet are utilized. The laminate layer 14*b* is entirely bonded to lid 1, but the laminate 14*a* is bonded to the lid 1 at only one portion thereof while the remaining portion not bonded to the lid extends vertically as a result of the elastic property thereof. The microwave energy is concentrated between the laminates layers 14*a* and 14*b* where by the energy is converted into heat energy due to the dielectric loss of the lid 1 so as to thereby partially melt and open the lid 1**.

Figure 18:
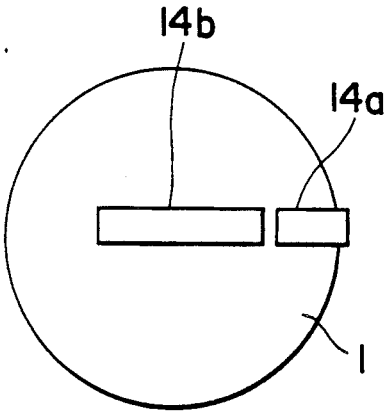
FIG. 18 is a plan view of sealed container constructed in accordance with fourteenth embodiment of this invention.
Figure 19:
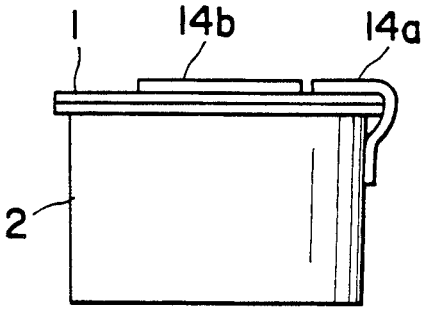
FIG. 19 is a side view of the sealed container shown in FIG. 18.

FIGS. 18 and 19 represent the fourteenth embodiment developed according to this invention, in which a pair of laminates **14*a* and 14*b* each comprising an antenna and a flexible insulative sheet are disposed upon the lid 1 each of the antennas being in the form of a belt. The lamination 14*b* is entirely bonded to the lid 1 and the lamination 14*a* is bonded to the lid 1 and a side portion of the container body 2. The microwave energy is concentrated at a position between the laminations 14*a* and 14*b*, where by the energy is then converted into head energy by means of the dielectric loss of the lid 1 so as to thereby partially melt and open the lid 1**.

Figure 20:
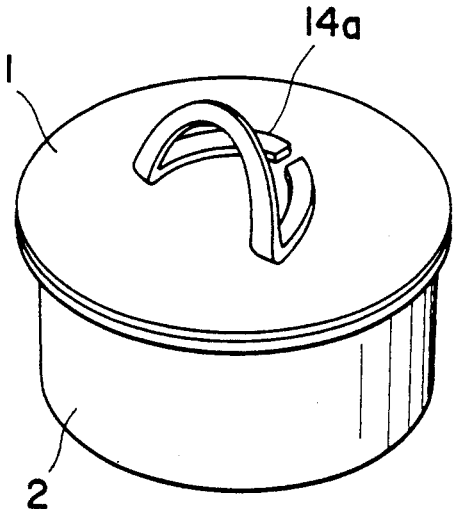
FIG. 20 is a perspective view of a sealed container constructed in accordance with the fifteenth embodiment of this invention.

In the fifteenth embodiment developed according to this invention and shown in FIG. 20, a C-shaped lamination layer **14*a* composed of an antenna and a flexible insulator sheet is utilized, and a part of the lamination 14*a* is bonded to the lid 1 while the remaining part extends substantially vertically as viewed as a result of the self-elasticity of the lamination 14*a*. The microwave energy is concentrated at a position defined between the opposing ends of the C-shaped lamination 14*a* and this energy is converted into heat energy by means of the dielectric loss of the lid so as to thereby partially melt and open the lid 1**.

Figure 21:
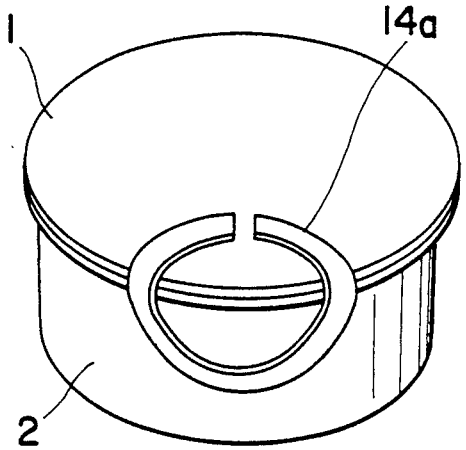
FIG. 21 is a perspective view of a sealed container constructed in accordance with the sixteenth embodiment of this invention.

In the sixteenth embodiment developed according to this invention shown in FIG. 21, a C-shaped lamination **14*a* comprising an antenna and a flexible insulative sheet is utilized, and the lamination 14*a* is bonded both to the lid 1 and to a side surface of the container body 2. The microwave energy is concentrated at a position defined between the opposing ends of the C-shaped lamination 14*a* and this energy is converted into heat energy by means of the dielectric loss of the lid thereby to fuse and open the lid 1**.

Figure 22:
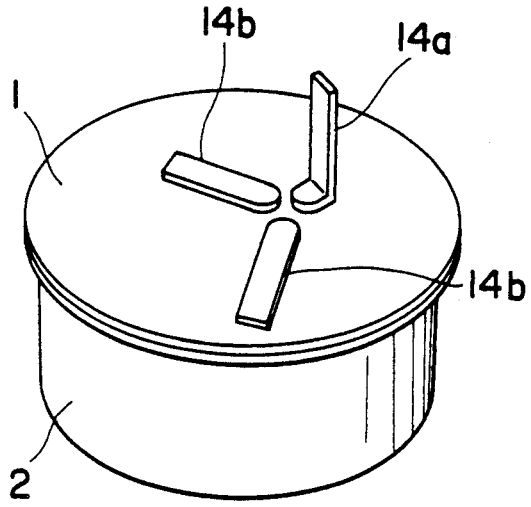

In the seventeenth embodiment developed according to this invention and shown in FIG. 22, two types of laminates **14*a* and 14*b* constituting the antennas and the flexible insulative sheets are utilized. The lamination 14*b* and 14*b* are entirely bonded to the lid 1, but the lamination 14*a* is partially bonded thereto. The remaining portion of the lamination 14*a* extends substantially vertically as viewed as a result of the self-elasticity of the lamination 14*a*. The microwave energy is concentrated at a position defined between the laminations 14*b* and the lamination 14 *a*, whereby the microwave energy is converted into heat energy by means of the dielectric loss of the lid so as to thereby partially melt and open the lid 1**.

Figure 23:
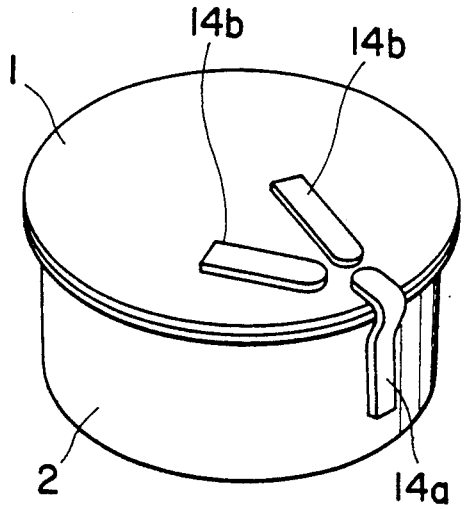
FIG. 23 is a perspective view of a sealed container constructed in accordance with the seventeenth embodiment of this invention.

In the eighteenth embodiment developed according to this invention and shown in FIG. 23, two types of laminations **14*a* and 14*b* constituting the antennas and the flexible insulative sheets are utilized. The laminations 14*b* and 14*b* are entirely bonded on the lid 1, but the lamination 14*a* is bonded to both the lid 1 and to a side surface of the container body 2. The microwave energy is concentrated at a position defined between the laminations 14*b* and the lamination 14*a*, whereby the microwave energy is converted into heat energy by means of the dielectric loss of the lid so as to thereby partially melt and open the lid 1**.

Figure 24:
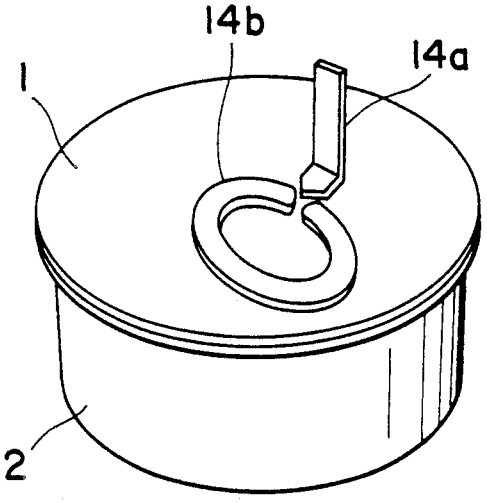
FIG. 24 is a perspective view of a sealed container constructed in accordance with the nineteenth embodiment of this invention.

In the nineteenth embodiment developed according to this invention and shown in FIG. 24, a C-shaped lamination 14*b* composed of an antenna and a flexible insulative sheet and a belt-shaped lamination 14*a* composed of an antenna and a flexible insulative sheet are utilized. The lamination 14*b* is entirely bonded to the lid 1, but the lamination 14*a* is partially bonded to the lid 1 while the remaining part extends substantially upwardly from the lid 1 as viewed as a result of the self-elasticity of the lamination 14*a*. Microwave energy is concentrated at a position defined between the lamination 14*a* and the opposing ends of the C-shaped lamination 14*b*, whereby this energy is converted into heat energy by means of the dielectric loss of the lid so as to thereby partially melt and open the lid 1.

Figure 25:
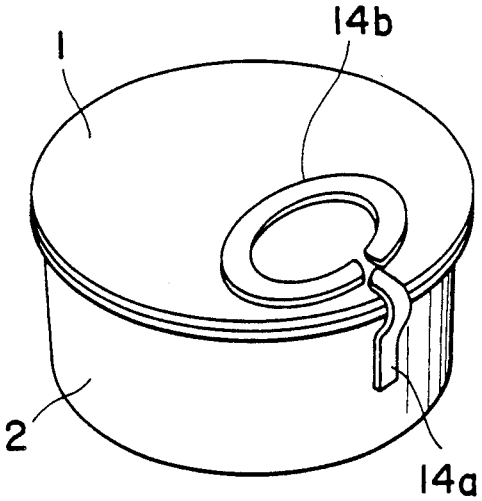
FIG. 25 is a perspective view of a sealed container constructed in accordance with the twentieth embodiment of this invention.

In the twentieth embodiment developed according to this invention and as shown in FIG. 25, a C-shaped lamination 14*b* composed of an antenna and a flexible insulative sheet and a belt-shaped lamination 14*a* composed of an antenna and a flexible insulative sheet are utilized. The lamination 14*b* is entirely bonded to the lid 1, but the lamination 14*a* is bonded to both the lid 1 and to a side surface of the container body 2. The microwave energy is concentrated at a position defined between the lamination 14*a* and the opposing ends of the C-shaped lamination 14*b*, whereby this energy is converted into heat energy by means of the dielectric loss of the lid so as to thereby partially melt and open the lid 1.

Sealed containers constructed according through the ninth to twentieth embodiments of this invention and sealed containers having structures substantially the same as those of the described embodiments except that the longitudinal sides of the antennas extend horizontally were prepared in which the lids 1 were made of laminated layers of polyester/nylon/polypropylene layers. Food comprising rice boiled together with red beans (SEKIHAN) having a volume of 200 g was filled and sealed within the respective containers, which were then disposed at the central portion of the microwave oven (National Electronic Oven NE-M200, Output: 500W, Lower Stirrer-type) and heated for two minutes. The containers prepared according to the described embodiments were all opened within 10 to 30 seconds, but some of the containers provided with the horizontally extending antennas were not completely opened within this heating time.

This invention is not limited to the described embodiments and many changes and modifications may be made. For example, the antennas of the thirteenth to through the twentieth embodiments may be utilized in a combined manner and such antennas may be entirely completely bonded to the lid of the eleventh embodiment and the heat generating element may be positioned at a portion position defined between the antennas and at which the microwave energy can be concentrated.

In the foregoing embodiments, the heat generating elements utilize not only high resistance substances but also other substances which generate heat by absorbing the microwave energy, that is, substances which generate heat due to magnetic losses, dielectric losses or discharges in lieu of the resistance losses.

As an element or substance which generates heat due to magnetic losses, there may be used a ferromagnetic alloy made of, for example, ferrite, iron, cobalt, nickel, which are represented by means of the chemical formula $MOFe_2O_3$ (where M is a divalent metallic ion) and a combination of some of these substances. A high molecular compound such as, for example, an epoxy resin, neoplene, bakelite or nylon will be utilized for the heat generating element which generates heat due to the dielectric losses, and a substance having a large dielectric loss such as, for example, barium titanate may also be utilized for the heat generating element. As the heat generating element which generates heat due to discharge, there may be utilized a vacuum evaporation film of a metallic material such as for example, aluminum, iron or nickel, a vacuum evaporation film of a semiconductor material such as, for example, silicon, or a fibrous substance made of these substances.

Embodiments of the container sealed with lids or containers in the form of pouches or bags to which labels are bonded according to this invention will now be described hereunder.

Figure 26:
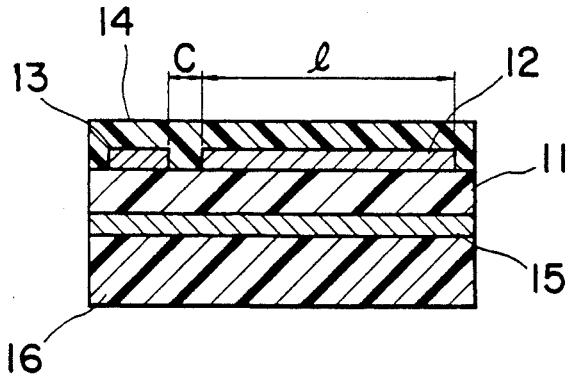
FIG. 26 is a sectional view of a label constructed in accordance with the twenty-first embodiment of this invention.

A label characteristic of the twenty-first embodiment of this invention is shown in FIG. 26, in which an electrically conductive layer 12 and a heat generating layer 13 are laminated upon a base layer 11 and a protection layer 14 is additionally laminated so as to enclose the conductive layer 12 and the heat generating layer 13. A layer 15 of a bonding agent or an adhesive is also laminated beneath the base layer 11 and a releasing layer 16 is temporarily bonded to the adhesive layer 15. The base layer 11 is composed of a single lamination layer of a thermoplastic sheet, thermosetting plastic sheet or paper material having a thickness suitable for providing a proper rigidity to the label. The conductive layer 12 is prepared from a substance which may form a thin film having, for example, a surface resistivity below less than 1Ω per square such as a metallic foil, flame coating film or conductive coating film. If the conductive layer 12 is composed of a substance having a surface resistivity greater than 1Ω per square, the substance itself absorbs the microwave energy and generates the heat and, hence, it is not proper to use the substance as an antenna for concentrating the microwave energy. It is also necessary for the conductive layer 12 to have a length more greater than 20 mm because if the length is less than 20 mm, the conductive layer is affected by means of the electric field distribution within the electronic oven and the heat is not stably generated. The configuration of the conductive layer may be that of a linear line, curved line or polygonal line, or a combination of these lines.

The heat generating layer 13 is prepared from a substance which absorbs the microwave energy and generates heat and may be, for example, a ferrite or a ferromagnetic alloy having a large magnetic loss, barium titanate having a large dielectric loss, or a conductive coating film, conductive plastic or vacuum evaporation film having a large resistance loss may be utilized for the material of the heat generating layer 13. When the material having a large resistance loss is utilized, it is desired for the material to have a surface resistivity greater than 11Ω per square because if the material has a surface resistivity less than 11Ω per square, the material not only absorbs the microwave energy but also reflects the same, thus reducing the heat generating function. The heat generating layer 13 may be formed so as to have a circular shape or polygonal shape, or a combination of these shapes. It is necessary that the diameter C between the conductive layer 12 and the heat generating layer 13 be within the range of 0 to 3.5 mm, and if the distance is greater than value of 3.5 mm, it is impossible to apply an adequate amount of heat to the portion of the lid to be opened. The protection layer 14 serves to protect the conductive layer 12 and the heat generating layer 13 and is prepared from an insulative plastic sheet or a coating film which is bonded, fused or coated to the conductive layer 12, the heat generating layer 13 and the base layer 11. The adhesive layer 15 is prepared from an acrylic bonding agent utilized for the bonding of a conventional label. The releasing layer 16 serves to protect the adhesive layer 15 and is prepared from a film essentially consisting of a plastic material and having a low adhesive property, the releasing layer essentially consisting of a surface treated film or paper, or a material prepared by means of coating a paper with a plastic material.

Figure 27:
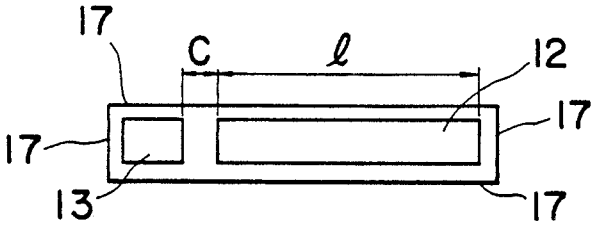
FIG. 27 is a plan view of the label shown in FIG. 26.

The label having the structure described above is provided with a cut line 17 within the base layer 11 around the conductive layer 12 and the heat generating layer 13 as shown in FIG. 27, and the upper portion of the releasing layer 16 is peeled off along the cut line 17. The label is thus bonded to the lid of the sealed container or the bag through means of the adhesive layer 15. It is desired to display the type of usage of this label to a user, and for this purpose, printed indicia may be directly made upon the conductive layer 12 or protection layer 14.

Figure 28:
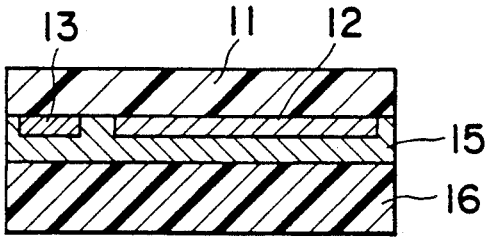
FIG. 28 is a sectional view of a label constructed in accordance with the twenty-second embodiment of this invention.

In connection with the twenty-second embodiment constructed according to this invention and shown in FIG. 28, the base layer 11 is endowed with the function of the protection layer, and the conductive layer 12 and the heat generating layer 13 are laminated between the base layer 11 and the adhesive layer 15. The other structural features and functions of the embodiment shown in FIG. 28 are substantially the same as those described with reference to the embodiment of FIG. 27.

Figure 29:
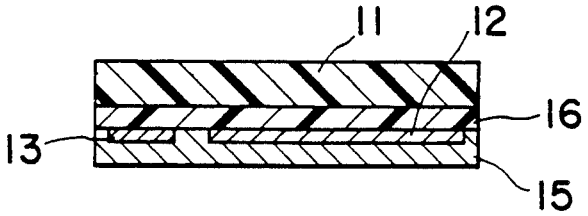
FIG. 29 is a sectional view of a label constructed in accordance with the twenty-third embodiment of this invention.

In connection with the twenty-third embodiment constructed according to this invention, and shown in FIG. 29, the adhesive layer 15 is composed of a hot metal type bonding agent. The adhesive layer 15 is disposed upon the surface of the lid or bag of the container and heat pressed thereon by means of heat transmitted through the base layer 11, whereby the adhesive layer 15 is softened and bonded to the lid of the container or the bag with the releasing layer 16, the conductive layer 12 and the heat generating layer 13 removed from the base layer 11.

The twenty-first embodiment developed according to this invention will now be described more particularly hereunder.

EXAMPLE 1

A polyethylene terephthalate film, having a thickness of 25 μm, prepared by means of a biaxial orientation method was utilized as the base layer 11, and an electrically conductive silver paste, having a length of 45 mm and a thickness of 5 μm, prepared as the conductive layer 12 was coated upon the base layer 11. The surface resistivity of the thus prepared conductive layer was 0.2Ω per square. An electrically conductive thin film of carbon paste (thickness: 3 μm; surface resistivity: 400Ω per square) was deposited onto the base 11 as the heat generating layer 13 by means of a screen printing method. A polyethylene terephthlate film, having a thickness of 25 μm, prepared by means of a biaxial orientation method, was prepared as the protection layer 14, and the protection layer 14 was bonded to the base layer 11 by means of a urethane bonding agent. An acrylic solvent type substance was utilized as the adhesive layer 15 and a polyethylene laminate glassing paper was utilized as the releasing layer 16.

Curry was deposited into in a cup made of polypropylene and adapted to contain a volume amount of 200 g, and the cup was then sealed by means of a lid made as a lamination of polyester/nylon/polypropylene layers. A label was bonded upon the lid. The thus prepared sealed container was inserted into a microwave oven (output power: 500W; National Electronic Oven NE-M 200), within which the container was exposed to the microwaves so as to examine the lid opening test. The results of the several containers indicated that the lids were consistent opened in about 20 seconds and steam was exhausted through the opening even when the locations of the containers within the electronic oven were altered.

EXAMPLE 2

A lamination of polyester/nylon/polypropylene layers was utilized for preparing a container in the form of a pouch or bag, with the polypropylene layer disposed inwardly, having outer dimensions of 170×130 mm, and rice in the amount of 200 g weight was deposited into in the container, which was then sealed. A label having substantially the same structure as that of the Example 1 was bonded to the container. The thus prepared sealed container was inserted into a microwave oven (output power: 500 W; National Electronic Oven NE-M 200), in which the container was exposed to the microwaves so as to examine the lid opening test. The results of the examination of the several containers indicated that the lids were opened in approximately 10 to 30 seconds and steam was exhausted through means of the opening without breaking the bag container even when the locations of the containers within the microwave oven were altered.

It is to be noted that this invention is not limited to the described embodiments and various changes and modifications may be made. For example, the heat generating layer and the conductive layer may be laminated separately upon the front and rear surfaces of the base layer without laminating the same upon the same side of the base layer.

Further, the flexible sheets having insulative properties as noted in connection with the respective embodiments described above comprise sheets defined by means of a single or combined materials of a thermoplastic sheet, thermosetting plastic sheet, and paper sheet. As a thermoplastic resin, there may be used a linear polyester such as polyethylene terephthalate, polyolefin resin such as, for example, ionomer, polyethylene, polypropylene, ethylene-propylene copolymer, acrylic resin, polystyrene resin, AS resin, ABS resin, polyamide resin, polyimide resin, polyimine resin, polyvinyl chloride resin, polyvinylien chloride resin, vinyl chloride-vinyl acetate copolymer, vinyliden copolymer, acetal resin, diallyl phethalate resin, fluoride resin, or a resin prepared as a result of the combination of a plurality of these resins. As the thermosetting plastic resin, there may be used a urea resin, phenol resin, epoxy resin, melamine resin, urethane resin, xylene-formaldehyde resin, or a resin prepared as a result the combination of a plurality of these resins.

INDUSTRIAL USAGE

As described hereinbefore, the sealed containers constructed according to this invention are suitable to be heated within an electronic, particularly microwave, oven or a microwave generating box so as to cook the food accommodated within the container which is disposed in the sealed condition.

Obviously, many variations and modifications of the present invention are possible in light of the above teachings. It is therefore to be understood that within the scope of the appended claims, the present invention may be practiced otherwise than as specifically described herein.

We claim:

1. A sealed container for containing food to be cooked within a microwave oven, comprising:

a container body having an opening defined within an upper portion thereof;

lid means, fabricated from a flexible sheet having insulative properties, for sealing said opening of said container body; and antenna means, fabricated from an electrically conductive material, laminated upon said lid means, and having opposed ends for generating an electrical field therebetween in response to said antenna means interacting with microwaves generated within said microwave oven whereby a portion of said lid means, defined between said opposed ends of said antenna means, is heated and partially melted by means of dielectric heating so as to develop a vent opening within said lid means.

2. A sealed container for containing food to be cooked in a microwave oven according to claim 1, wherein said antenna has a C-shaped configuration.

3. A sealed container for containing food to be cooked in a microwave oven according to claim 1, wherein a heat generating substance is disposed adjacent to one of said ends of said antenna.

4. A sealed container for containing food to be cooked in a microwave oven according to claim 1, wherein said portion of said lid to be heated and partially melted is a pheripheral portion of said lid to be sealed with the container body.

5. A sealed container as set forth in claim 1, wherein: said antenna means comprises at least two antennas laminated upon said lid means.

6. A sealed container for containing food to be cooked within a microwave oven, comprising:

a container body having an opening defined within an upper portion thereof;

lid means, fabricated from a flexible sheet having insulative properties, for sealing said opening of said container body;

heat generating means disposed upon said lid means; and antenna means, fabricated from an electrically conductive material, disposed upon said lid means such that one end portion of said antenna means is disposed adjacent to said heat generating means whereby, when an electrical field is developed within said antenna means in response to said antenna means interacting with microwaves generated within said microwave oven, an electrical current will be conducted within said heat generating means so as to generate heat for partially melting a portion of said lid means and thereby form a vent opening within said lid means.

7. A sealed container for containing food to be cooked in a microwave oven according to claim 2, wherein a portion of said lid to be heated and partially melted is a pheripheral portion of said lid to be sealed with the container body.

8. A sealed container for containing food to be cooked within a microwave oven, comprising:

a container body having an opening defined within an upper portion thereof;

lid means, fabricated from a flexible sheet having insulative properties, for sealing said opening of said container body; and antenna means, fabricated from an electrically conductive material, laminated upon said lid means, and having a portion thereof inclined at an angle greater than 3° with respect to a horizontal plane, for concentrating microwave energy toward a specific portion of said lid means when said sealed container is exposed to microwaves within said microwave oven whereupon microwave energy is converted into heat energy so as to for a vent opening within said lid means.

9. A sealed container for containing food to be cooked in a microwave oven according to claim 8, wherein a heat generating substance for converting microwave energy into heat energy is laminated on the lid and the microwave energy concentrated by said antenna is converted into heat energy by said heat generating substance.

10. A sealed container for containing food to be cooked in a microwave oven according to claim 9, wherein said antenna has a belt shape and said heat generating substance is laminated on said lid adjacent to said antenna.

11. A sealed container for containing food to be cooked in a microwave oven according to claim 8, wherein the microwave energy concentrated by said antenna is converted into heat energy due to the dielectric loss of said lid.

12. A sealed container for containing food to be cooked in a microwave oven according to claim 8, wherein said antenna has a C-shaped configuration as seen in a plan view and the microwave energy is concentrated between opposing ends of said antenna.

13. A sealed container for containing food to be cooked in a microwave oven according to claim 8, wherein said antenna is composed of at least two antenna elements and the microwave energy is concentrated at a portion at which said antenna elements are close to each other, 14. A sealed container for containing food to be cooked in a microwave oven according to claim 8, wherein said lid is horizontally disposed and said antenna is laminated on a flexible sheet having an insulative property, said flexible sheet having a first portion bonded to said lid while a second remaining portion extends in a direction away from said lid as a result the self-elasticity of said flexible sheet.

15. A sealed container for containing food to be cooked in a microwave oven according to claim 8, wherein said lid is horizontally disposed, at least two kinds of flexible sheets having insulative properties and having different coefficients of thermal contraction are laminated upon opposite sides of said antenna, a portion of a first laminating layer is bonded to said lid, and the remaining portion of said first laminating not bonded to said lid is displaced so as to extend away from said lid due to the thermal deformation of the remaining portion of the first lamination layer.

16. A sealed container for containing food to be cooked in a microwave oven according to claim 8, wherein when the container body is disposed so that the bottom surface thereof is disposed within a horizontal plane, at least a portion of said lid is inclined at an angle greater than 3° with respect to the horizontal plane and said antenna is laminated on a portion of said lid in the inclined direction.

17. A sealed container for containing food to be cooked in a microwave oven according to claim 8, wherein said antenna is bonded to said lid and a side surface of said container body.

18. A sealed container for containing food to be cooked within a microwave oven, comprising:

a container body having an opening defined within an upper portion thereof;

lid means, fabricated from a flexible sheet having insulative properties, for sealing said opening of said container body; and label means disposed upon said lid for providing said lid means with a vent opening when said sealed container is exposed to microwaves within said microwave oven, said label comprising a laminate of an adhesive layer; a heat generating layer for converting microwave energy into heat energy; and an electrically conductive layer, in the form of a linear belt having a longitudinal length of at least 20 mm and a surface resistivity of less than 1Ω per square, for concentrating said microwave energy toward said heat generating layer, said electrically conductive layer being disposed adjacent to said heat generating layer with a distance of 0–3.5 mm defined therebetween.

19. A sealed container for containing food to be cooked in a microwave oven according to claim 18, wherein said label further comprises a base layer, the conductive layer and the heat generating layer both being laminated on the base layer, a protection layer arranged so as to enclose said conductive layer and said heat generating layer, and a releasing layer releasably applied to the adhesive layer which is laminated below said base layer.

20. A sealed container for containing food to be cooked in a microwave oven according to claim 18, wherein said label includes a base layer, the conductive layer and the heat generating layer both laminated below the base layer, the adhesive layer arranged so as to enclose said conductive layer and said heat generating layer, and a releasing layer releasably applied to the adhesive layer.

21. A sealed container for containing food to be cooked in a microwave oven according to claim 18, wherein said label includes a base layer, a releasing layer releasably applied to the lower side of the base layer, the conductive layer and the heat generating layer both laminated below the releasing layer, and a hot melt adhesive layer laminated so as to enclose said conductive layer and said heat generating layer while being bonded to said releasing layer.

22. A sealed container for containing food to be cooked within a microwave oven, comprising:

a container body in the form of a sealed pouch fabricated from a flexible material having insulative properties; and label means disposed upon said sealed pouch for providing said sealed pouch with a vent opening when said sealed pouch is exposed to microwaves within said microwave oven, said label comprising a laminate of an adhesive layer; a heat generating layer for converting microwave energy into heat energy; and an electrically conductive layer, in the form of a linear belt having a longitudinal extent of at least 20 mm and a surface resistivity of less than 1Ω per square, for concentrating said microwave energy toward said heat generating layer, said electrically conductive layer being disposed adjacent to said heat generating layer with a distance of 0–3.5 mm defined therebetween.

23. A sealed container as set forth in claim 22, wherein said label comprises:

a base layer;

said conductive layer and said heat generating layer are both laminated upon said base layer;

a protection layer is disposed so as to enclose said conductive layer and said heat generating layer; and a releasing layer releasably applied to said adhesive layer and laminated beneath said base layer.

24. A sealed container as set forth in claim 22, wherein said label comprises:

a base layer;

said conductive layer and said heat generating layer are both laminated beneath said base layer;

said adhesive layer encloses said conductive layer and said heat generating layer; and a releasing layer is releasably applied to said adhesive layer.

25. A sealed container as set forth in claim 22, wherein said label comprises:

a base layer;

a releasing layer releasably applied to the lower side of said base layer;

said conductive layer and said heat generating layer are both laminated beneath said releasing layer; and a hot melt adhesive layer is laminated so as to enclose said conductive layer and said heat generating layer while being bonded to said releasing layer.

26. A sealed container as set forth in claim 6, wherein:

said antenna means comprises a pair of antennas; and said heat generating means is interposed therebetween.

27. A sealed container as set forth in claim 26, wherein:

said pair of antennas and said heat generating means have substantially arcuate configurations.

* * * * *